US010882173B2

(12) United States Patent
Shimizu et al.

(10) Patent No.: US 10,882,173 B2
(45) Date of Patent: Jan. 5, 2021

(54) STAPLER

(71) Applicant: MAX CO., LTD., Tokyo (JP)

(72) Inventors: Toshio Shimizu, Tokyo (JP); Futoshi Kameda, Tokyo (JP); Shinpei Sugihara, Tokyo (JP)

(73) Assignee: MAX CO., LTD., Tokyo (JP)

( * ) Notice: Subject to any disclaimer, the term of this patent is extended or adjusted under 35 U.S.C. 154(b) by 156 days.

(21) Appl. No.: 15/786,878

(22) Filed: Oct. 18, 2017

(65) Prior Publication Data

US 2018/0117749 A1 May 3, 2018

(30) Foreign Application Priority Data

Oct. 31, 2016 (JP) ..... 2016-213885

(51) Int. Cl.

| | |
|---|---|
| ***B27F 7/19*** | (2006.01) |
| ***B27F 7/23*** | (2006.01) |
| ***B25C 5/16*** | (2006.01) |
| ***B27F 7/38*** | (2006.01) |

(52) U.S. Cl.

CPC ..... *B25C 5/1624* (2013.01); *B27F 7/19* (2013.01); *B27F 7/23* (2013.01); *B27F 7/38* (2013.01)

(58) Field of Classification Search

CPC .. B25C 5/1624; B27F 7/19; B27F 7/23; B27F 7/38

USPC ..... 227/155, 120, 79

See application file for complete search history.

(56) References Cited

U.S. PATENT DOCUMENTS

| | | | | |
|---|---|---|---|---|
| 3,034,382 A * | 5/1962 | Hazel | H05K 13/0473 | 29/566 |
| 4,844,319 A * | 7/1989 | Kurosawa | B27F 7/19 | 227/79 |
| 6,250,531 B1 * | 6/2001 | Yagi | B27F 7/19 | 227/155 |
| 7,195,141 B2 * | 3/2007 | Elonsson | B25C 5/0207 | 227/134 |

(Continued)

FOREIGN PATENT DOCUMENTS

| | | |
|---|---|---|
| JP | 2005-119246 A | 5/2005 |
| JP | 2005-119247 A | 5/2005 |
| WO | 2006-009017 A1 | 1/2006 |

OTHER PUBLICATIONS

Office Action issued for corresponding Japanese Application No. 2016-213885 dated Oct. 27, 2020 (2 pages).

*Primary Examiner* — Hemant Desai
*Assistant Examiner* — Christopher Robin Kim
(74) *Attorney, Agent, or Firm* — Rothwell, Figg, Ernst & Manbeck, P.C.

(57) ABSTRACT

The cutting portion includes a pair of introduction portions allowing the staple legs penetrating the sheets of paper to be introduced therein, a pair of cutting members configured to cut the staple legs introduced in the introduction portions, and a discharging path configured to discharge cut staples cut by the cutting members. The discharging path includes a temporary receiving portion for the cut staples provided between the pair of introduction portions. The temporary receiving portion includes a pair of inlet portions respectively provided on side surfaces thereof opposing the introduction portions. The pair of inlet portions are configured to allow the cut staples cut by the cutting members to enter therein.

7 Claims, 5 Drawing Sheets

(56) References Cited

U.S. PATENT DOCUMENTS

| | | | | |
|---|---|---|---|---|
| 7,850,054 | B2 * | 12/2010 | Shimizu | B27F 7/21 227/79 |
| 7,922,060 | B2 * | 4/2011 | Kishi | B27F 7/19 227/155 |
| 2007/0034665 | A1 | 2/2007 | Shimizu et al. | |
| 2008/0035699 | A1 | 2/2008 | Shimizu et al. | |
| 2008/0223899 | A1 * | 9/2008 | Kishi | B27F 7/38 227/79 |

* cited by examiner

STAPLER

CROSS-REFERENCE TO RELATED APPLICATION

This application claims priority from Japanese Patent Application No. 2016-213885 filed on Oct. 31, 2016, the entire contents of which are incorporated herein by reference.

TECHNICAL FIELD

The present invention relates to a stapler for binding a plurality of sheets of paper with a staple.

BACKGROUND

In electric staplers used in post-processing devices, a technique has been proposed, in which staples having staple legs of a length capable of binding the maximum assumed number of sheets of paper are received therein and if the number of sheets of paper to be bound are smaller and the like, the staple legs are cut and then used for binding.

In such staplers, a configuration has been proposed, in which a staple striking portion for striking a staple to penetrate sheets of paper is arranged on a lower side thereof and a binding portion for binding the sheets of paper by bending the staple legs of the staple penetrating the sheets of paper is arranged on an upper side thereof.

A cutting portion for cutting the staple legs is provided in the binding portion, and introduction portions allowing the staple legs penetrating the sheets of paper to be introduced into the cutting portion are formed by downward openings (e.g., see Japanese Patent Application Publication No. 2005-119246).

Also, in order to collect cut staples, which are cut by the cutting portion, from a temporary receiving portion configured to temporarily receive the cut staples, a configuration has been proposed, in which a discharging path for the cut staples is communicated with an opening formed in a lower surface of the temporary receiving portion (e.g., see Japanese Patent Application Publication No. 2005-119247).

In conventional staplers, the introduction portions for cut staples are formed by downward openings. Therefore, there is a possibility that cut staples after cutting are dropped from the introduction portions to the outside.

Also, a path for discharging the cut staples is complex and thus there is a possibility that the cut staples stay in the temporary receiving portion. When the lower surface of the temporary receiving portion is opened and the cut staples stay in the temporary receiving portion, the introduction portions for the staple have an increased possibility that the cut staples after cutting are dropped from the introduction portions to the outside.

SUMMARY

Accordingly, the present invention has been made to solve the above problems, and an object thereof is to provide a stapler in which it is possible to inhibit cut staples from being dropped to the outside and also to inhibit the cut staples from staying, thereby ensuring that the cut staples are reliably collected.

In order to solve the above object, the present invention is a stapler, including a staple striking portion for striking a staple to penetrate sheets of paper; a cutting portion for cutting staple legs of the staple penetrating the sheets of paper; and a binding portion for binding the sheets of paper by bending the staple legs of the staple penetrating the sheets of paper; wherein the cutting portion includes a pair of introduction portion allowing the staple legs penetrating the sheets of paper to be introduced therein, a pair of cutting members for cutting the staple legs introduced in the introduction portions, and a discharging path for discharging cut staples cut by the cutting members; wherein the discharging path includes a temporary receiving portion for the cut staples provided between the pair of introduction portion, wherein the temporary receiving portion includes a pair of inlet portions respectively provided on side surfaces thereof opposing the introduction portions and configured to allow the cut staples cut by the cutting members to enter therein.

Also, the present invention is a stapler suitable for a post-processing device having a stapler for binding sheets of paper with a staple and configured to perform a post-processing on sheets of paper with an image formed thereon, wherein the stapler includes a staple striking portion for striking a staple to penetrate sheets of paper; a cutting portion for cutting staple legs of the staple penetrating the sheets of paper; and a binding portion for binding the sheets of paper by bending the staple legs of the staple penetrating the sheets of paper; wherein the cutting portion includes a pair of introduction portion allowing the staple legs penetrating the sheets of paper to be introduced therein, a pair of cutting members for cutting the staple legs introduced in the introduction portions, and a discharging path for discharging cut staples cut by the cutting members; wherein the discharging path includes a temporary receiving portion for the cut staples provided between the pair of introduction portion, wherein the temporary receiving portion includes a pair of inlet portions respectively provided on side surfaces thereof opposing the introduction portions and configured to allow the cut staples cut by the cutting members to enter therein.

Further, the present invention is a stapler suitable for an image formation system including an image formation device configured to form an image on a sheet of paper and then to output the sheet of paper, and the post-processing device as described above connected to the image formation device and configured to perform a post-processing on the sheets of paper.

According to the present invention, the staple legs of the staple penetrating the sheets of paper enter the introduction portions of the cutting portion, are cut by operation of the cutting members and then enter the temporary receiving portion through the inlet portions provided on side surfaces of the temporary receiving portion. The cut staples, which have entered the temporary receiving portion, are discharged through the discharging path.

According to the present invention, the inlet portions for the cut staples are provided on the side surfaces of the temporary receiving portion, but no introduction portion for staple legs is provided on a lower surface of the temporary receiving portion. Therefore, it is possible to inhibit the cut staples, which have entered the temporary receiving portion, from being dropped to the outside of the cutting portion through the introduction portions. As a result, it is possible to reliably guide the cut staples, which have entered the temporary receiving portion, to the discharging path, thereby ensuring that the cut staples can be discharged from the discharging path.

DETAILED DESCRIPTION

Hereinafter, embodiments of a stapler according to the present invention, a post-processing device having the stapler and an image formation system having the post-processing device will be described with reference to the accompanying drawings.

Exemplary Configuration of Stapler of the Present Embodiment

Figure 1:
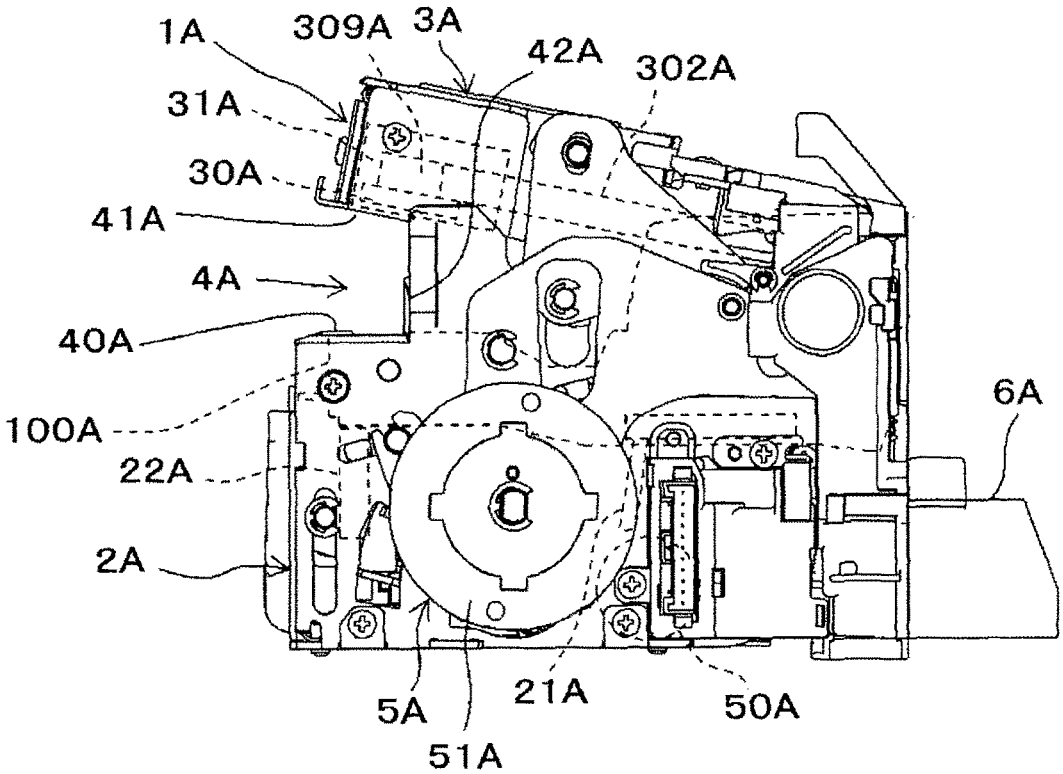
FIG. 1 is a side view showing one example of a stapler of the present embodiment.
Figure 2:
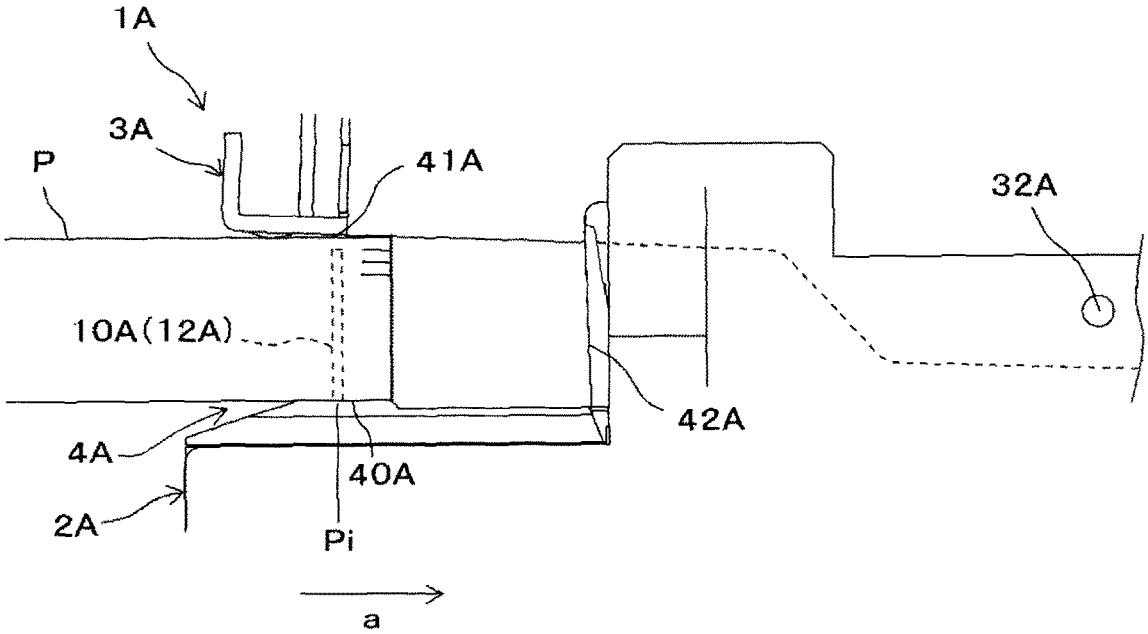
FIG. 2 is a side view showing a main part of the example of the stapler of the present embodiment.

FIG. 1 is a side view showing one example of a stapler of the present embodiment, and FIG. 2 is a side view showing a main part of the example of the stapler of the present embodiment. Further, FIG. 3 is an explanatory view showing one example of an operation of binding sheets of paper with a staple.

Figure 3A:
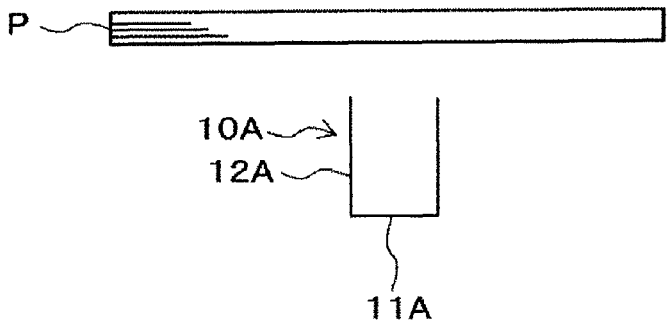
FIGS. 3A to 3D are explanatory views showing one example of an operation of binding sheets of paper with a staple.

First, an operation of binding sheets of paper P with a stapler 1A will be described with reference to FIG. 3. As shown in FIG. 3A, a staple 10A has staple legs 12A formed by bending both ends of a staple crown 11A toward one direction. That is, the staple 10A is shaped in a generally U-shape.

Figure 3B:
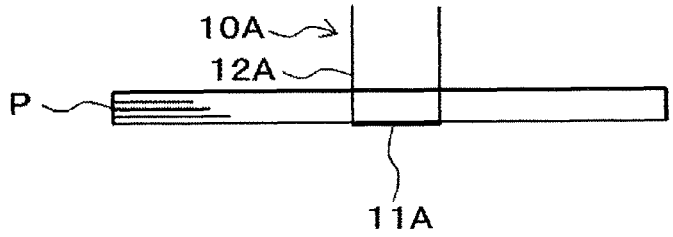
Figure 3C:
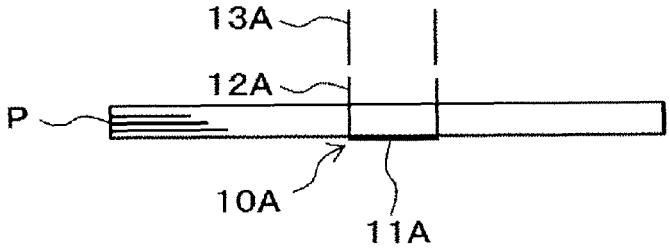

As shown in FIG. 3B, the staple 10A is configured such that as the staple crown 11A is pressed, the staple legs 12A penetrate sheets of paper P and then the staple crown 11A comes in contact with the sheets of paper P. In the staple 10A of which the staple legs 12A have penetrated the sheets of paper P, as shown in FIG. 3C, surplus parts of the staple legs 12A which are to overlap with each other when the staple legs 12A are bent are cut as cut staples 13A.

Figure 3D:
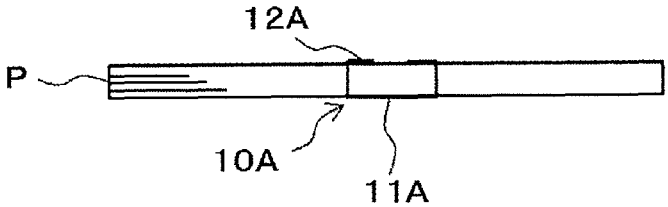

In the staple 10A of which the staple legs 12A have been cut into a predetermined length, as shown in FIG. 3D, the staple legs 12A penetrating the sheets of paper P are bent and thus the sheets of paper P are bound with the staple 10A.

Next, a configuration of the stapler 1A of the present embodiment will be described with reference to the figures. The stapler 1A includes a staple striking unit 2A for supplying and striking a staple 10A, and a binding unit 3A for binding sheets of paper P with the staple 10A by cutting and bending staple legs 12A of the staple 10A in cooperation with the staple striking unit 2A. Also, the stapler 1A has a paper clamping portion 4A for clamping a bundle of sheets of paper P between the staple striking unit 2A and the binding unit 3A using the staple striking unit 2A and the binding unit 3A.

In the following description, a side on which the paper clamping portion 4A is provided is referred to as a front side of the stapler 1A, and a side opposite to the side on which the paper clamping portion 4A is provided is referred to as a rear side thereof. Also, a side on which the binding unit 3A is provided is referred to as an upper side of the stapler 1A, and a side on which the staple striking unit 2A is provided is referred to as a lower side of the stapler 1A.

The staple striking unit 2A is an example of a staple striking portion and is configured such that a staple cartridge 100A, which is a staple receiving portion in which staples 10A are received, is removably attached thereon. The staple striking unit 2A has a feeding portion 21A for feeding a staple 10A from the staple cartridge 100A and a striking portion 22A for driving the staple 10A into sheets of paper P.

In the present example, staples 10A are provided as a staple sheet, in which a plurality of linear staples 10A are integrated by adhesion, and a plurality of staple sheets are stacked and received in the staple cartridge 100A. The striking portion 22A is configured to strike one staple 10A of the staple sheet, which is located at the most leading end in a conveying direction thereof, and at the same time to shape a second, and possibly a third, staple 10A into a generally U-shape as shown in FIG. 3A and the like.

The binding unit 3A is an example of a binding portion and has a cutting portion 30A for cutting staple legs 12A of the staple 10A, which have penetrated sheets of paper P, into a predetermined length, and a clincher portion 31A for bending the staple legs 12A of the staple 10A, which have penetrated the sheets of paper P and have been cut into the predetermined length, toward the sheets of paper P.

The paper clamping portion 4A has a shape, which is opened on front, right and left sides of the stapler 1A, so that a binding location Pi on the sheets of paper P at which the sheets of paper P are bound with the staple 10A can be positioned between the striking portion 22A and the clincher portion 31A.

The paper clamping portion 4A has a first clamping portion 40A provided on the staple striking unit 2A and also has a second clamping portion 41A provided on the binding unit 3A to oppose the first clamping portion 40A. The stapler 1A is configured to clamp sheets of paper P between the first clamping portion 40A and the second clamping portion 41A as the binding unit 3A is moved in a direction approaching the staple striking unit 2A by rotationally operating the binding unit 3A about a axis 32A.

The paper clamping portion 4A has a paper position restriction portion 42A for restricting a position of the sheets of paper P in an insertion direction thereof as shown by an arrow a. The paper position restriction portion 42A protrudes between the first clamping portion 40A and the second clamping portion 41A at an inner side of the paper clamping portion 4A with respect to the insertion direction of the sheets of paper P as shown by the arrow a. Therefore, the sheets of paper P inserted into the paper clamping portion 4A are restricted from being inserted more inward than the paper position restriction portion 42A.

The stapler 1A has a drive unit 5A. The drive unit 5A opens and closes the staple striking unit 2A and the binding unit 3A relative to each other. The drive unit 5A drives the feeding portion 21A and the striking portion 22A of the staple striking unit 2A and the cutting portion 30A and the clincher portion 31A of the binding unit 3A The drive unit 5A has a cam 51A driven by a motor 50A provided in the staple striking unit 2A, linkages (not shown) for transferring an operation of the cam 51A to each part, and the like According to the stapler 1A, as an operation of the cam 51A is transferred to the binding unit 3A via linkages and the like, the staple striking unit 2A and the binding unit 3A are moved relative to each other in separating/contacting directions, in which they separate from and contact with each other. In the present example, the binding unit 3A is moved relative to the staple striking unit 2A in the separating/contacting directions by a rotation operation thereof about the axis 32A.

According to the stapler 1A, the binding unit 3A is moved in a direction approaching the staple striking unit 2A by an operation, in which the cam 51A rotates in one direction, and thus the paper clamping portion 4A clamps sheets of paper P at a predetermined timing. Also, according to the stapler 1A, the binding unit 3A is moved in a direction separating from the staple striking unit 2A at a predetermined timing by an operation, in which the cam 51A further rotates in one direction, and thus clamping of the sheets of paper P by the paper clamping portion 4A is released.

Further, according to the stapler 1A, an operation of the cam 51A is transferred to the feeding portion 21A and the striking portion 22A via linkages and the like. Therefore, due to an operation in which the cam 51A rotates in one direction, staples 10A received in the staple cartridge 100A are fed by the feeding portion 21A, and then one of the fed staples 10A, which is located at the most leading end thereof, is driven into sheets of paper P, which are clamped by the paper claiming portion 4A, by the striking portion 22A. As a result, staple legs 12A of the staple 10A penetrate the sheets of paper P. Also, a second, and possibly a third, staple 10A is shaped into a generally U-shape as shown in FIG. 4A and the like.

Further, according to the stapler 1A, an operation of the cam 51A is also transferred to the cutting portion 30A and the clincher portion 31A via linkages and the like. Therefore, due to an operation in which the cam 51A rotates in one direction, the staple legs 12A of the staple 10A penetrating the sheets of paper P are cut into a predetermined length by the cutting portion 30A, and then the staple legs 12A of the staple 10A, which have been cut into the predetermined length, are bent by the clincher portion 31A.

The stapler 1A has a cut staple receiving portion 6A for receiving cut staples 13A cut by the cutting portion 30A. The cut staple receiving portion 6A is removably attached on the stapler 1A on a rear side of the stapler 1A opposite to a side thereof, on which the paper clamping portion 4A is provided.

Figure 4A:
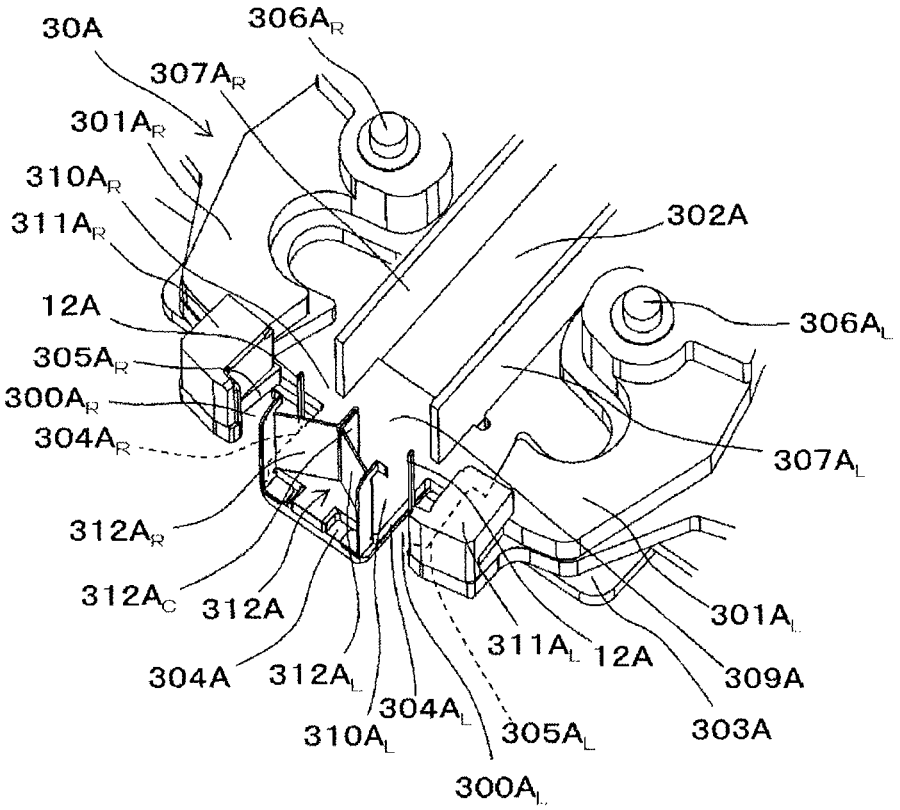
FIGS. 4A and 4B are configuration views showing one example of a cutting portion of the present embodiment.
Figure 4B:
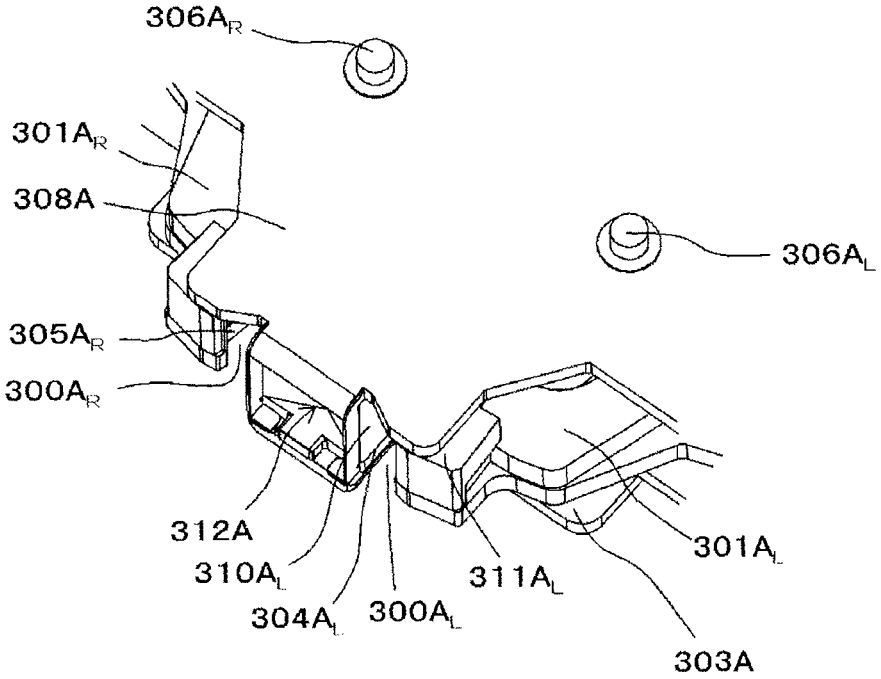
Figure 5:
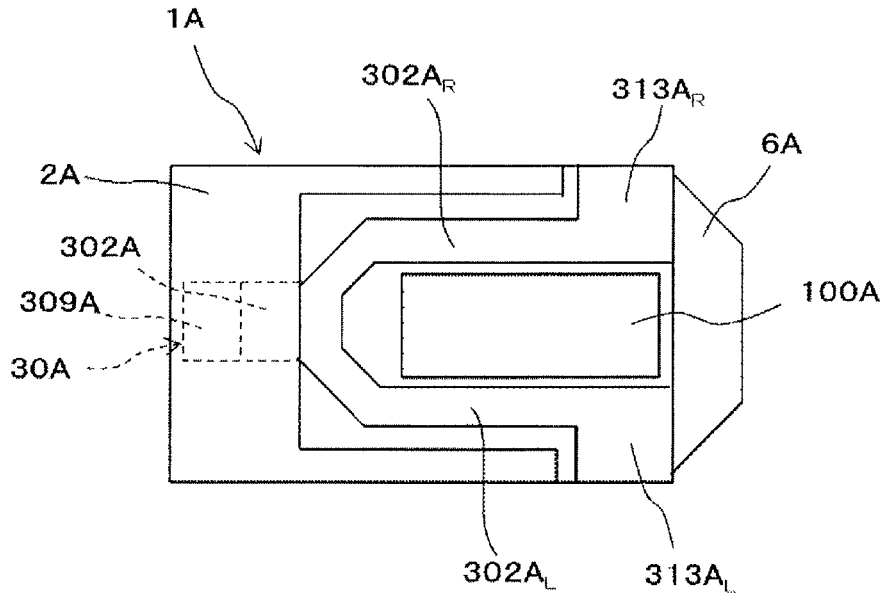
FIG. 5 is a configuration view showing one example of a discharging path.

FIGS. 4A and B are configuration views showing one example of the cutting portion of the present embodiment, and FIG. 5 is a configuration view showing one example of a discharging path. Next, the cutting portion 30A of the present embodiment will be described with reference to the figures.

The cutting portion 30A has introduction portions 300$A_L$, 300$A_R$ for the staple legs 12A penetrating the sheets of paper P, a pair of cutting members 301$A_L$, 301$A_R$ for cutting the staple legs 12A introduced in the introduction portions 300$A_L$, 300$A_R$, and a discharging path 302A for discharging cut staples 13A cut by the cutting members 301$A_L$, 301$A_R$ to the cut staple receiving portion 6A.

The cutting portion 30A has a protrusion 304A protruding from a support plate 303A to have a predetermined width narrower than a width of the staple crown 11A of the staple 10A and also has a support portion 304$A_L$ on one side surface of the protrusion 304A and a support portion 304$A_R$ on the other side surface thereof One cutting member 301$A_L$ is attached on an upper surface of the support plate 303A to be rotatable about a shaft 306$A_L$ and has a blade portion 305$A_L$ on a front end thereof opposing one support portion 304$A_L$.

The cutting member 301$A_L$ is driven by the motor 50A shown in FIG. 1, and the blade portion 305$A_L$ is moved in directions approaching and separating from the support portion 304$A_L$ by a rotation operation of the cutting member 301$A_L$ about the shaft 306$A_L$.

The cutting member 301$A_L$ is moved to a cutting ending position by a rotation operation in a direction, which causes the blade portion 305$A_L$ to approach the support portion 304$A_L$, and also to a waiting position by a rotation operation in a direction, which causes the blade portion 305$A_L$ to separate from the support portion 304$A_L$.

The other cutting member 301$A_R$ is attached on the upper surface of the support plate 303A to be rotatable about a shaft 306$A_R$ and has a blade portion 305$A_R$ on a front end thereof opposing the other support portion 304$A_R$.

The cutting member 301$A_R$ is driven by the motor 50A shown in FIG. 1, and the blade portion 305$A_R$ is moved in directions approaching and separating from the support portion 304$A_R$ by a rotation operation of the cutting member 301$A_R$ about the shaft 306$A_R$.

The cutting member 301$A_R$ is moved to a cutting ending position by a rotation operation in a direction, which causes the blade portion 305$A_R$ to approach the support portion 304$A_R$, and also to a waiting position by a rotation operation in a direction, which causes the blade portion 305$A_R$ to separate from the support portion 304$A_R$.

In the stapler 1A, a pair of staple legs 12A of a staple 10A are cut by a shear force exerted thereon by an operation in which the pair of the cutting member 301AL, 301AR move from outside to inside with respect to the respective staple legs 12A. Therefore, projections, which are created by shear and called barb, flash, buff, folded burr or the like, are formed on an inner side of each of the pair of staple legs 12A. As the staple legs 12A cut in that manner are bent inward by the clincher portion 31A, the projections are oriented toward the sheets of paper P.

In a state where the cutting member 301$A_L$ has moved to the waiting position, the one support portion 304$A_L$, which is formed on the support plate 303A, and the blade portion 305$A_L$ of the one cutting member 301$A_L$ opposing the support portion 304$A_L$ form therebetween a groove allowing the corresponding staple leg 12A to pass therethrough. The introduction portion 300$A_L$ is formed by the groove between the support portion 304$A_L$ and the blade portion 305$A_L$.

Similarly, in a state where the cutting member 301$A_R$ has moved to the waiting position, the other support portion 304$A_R$, which is formed on the support plate 303A, and the blade portion 305$A_R$ of the other cutting member 301$A_R$ opposing the support portion 304$A_R$ form therebetween a groove allowing the corresponding staple leg 12A to pass therethrough. The introduction portion 300$A_R$ is formed by the groove between the support portion 304$A_R$ and the blade portion 305$A_R$.

The discharging path 302A is partitioned by a pair of wall portions 307$A_L$, 307$A_R$ provided on the upper surface of the support plate 303A. The discharging path 302A is formed by a space extending rearward from between the introduction portion 300$A_L$ and the introduction portion 300$A_R$. The cutting portion 300A is configured such that an upper side of the discharging path 302A is closed with a top plate 308A.

The discharging path 302A has a temporary receiving portion 309A for cut staples 13A between the introduction portion 300$A_L$ and the introduction portion 300$A_R$. The temporary receiving portion 309A has an inlet portion 310$A_L$ on one side surface thereof opposing the introduction portion 300$A_L$ and also has an inlet portion 310$A_R$ on the other side surface thereof opposing the introduction portion 300$A_R$.

The inlet portion 310$A_L$ is formed by providing a predetermined-shaped opening in one wall portion 307$A_L$. The inlet portion 310$A_L$ is configured such that the blade portion 305$A_L$ of the cutting portion 301$A_L$ can enter therein and also a height from the support plate 303A to the top plate 308A is higher than the longest length of cut staples 13A.

The inlet portion 310$A_R$ is formed by providing a predetermined-shaped opening in the other wall portion 307$A_R$. The inlet portion 310$A_R$ is configured such that the blade portion 305$A_R$ of the cutting portion 301$A_R$ can enter therein and also a height from the support plate 303A to the top plate 308A is higher than the longest length of cut staples 13A.

The cutting portion 301$A_L$ has a lid portion 311$A_L$ configured to close the inlet portion 310$A_L$ by an operation of cutting the corresponding staple leg 12A. The lid portion 311$A_L$ is provided on an upper side of the blade portion 305$A_L$ and has a shape allowing the lid portion 311$A_L$ to enter and thus close the inlet portion 310$A_L$.

The cutting portion 301$A_R$ has a lid portion 311$A_R$ configured to close the inlet portion 310$A_R$ by an operation of cutting the corresponding staple leg 12A. The lid portion 311$A_R$ is provided on an upper side of the blade portion 305$A_R$ and has a shape allowing the lid portion 311$A_R$ to enter and thus close the inlet portion 310$A_R$.

The temporary receiving portion 309A has a partition plate 312A between the inlet portion 310$A_L$ and the inlet portion 310$A_R$. The partition plate 312A is an example of a partition member and has a direction regulation portion 312$A_L$ inclined in a direction opposing the inlet portion 310$A_L$ and the discharging path 302A, a direction regulation portion 312$A_R$ inclined in a direction opposing the inlet portion 310$A_R$ and the discharging path 302A, and a shield portion 312$A_C$ between the inlet portion 310$A_L$ and the inlet portion 310$A_R$.

The partition plate 312A protrudes between the inlet portion 310$A_L$ and the inlet portion 310$A_R$ and is configured to close a path, along which the cut staple 13A cut by the cutting member 301$A_L$ is directed, and a path, along which the cut staple 13A cut by the cutting member 301$A_R$ is directed.

The discharging path 302A extends rearward from the temporary receiving portion 309A in a linear shape. One discharging path 302A is branched into two discharging paths 302$A_L$, 302$A_R$, which are respectively arranged on left and right sides of the staple cartridge 100A, which is an example of a staple receiving portion, to bypass a path along which the staple cartridge 100A is attached and detached.

In the stapler 1A, a discharging port 313$A_L$ of one discharging path 302$A_L$ is communicated with one collecting port (not shown) of the cut staple receiving portion 6A, and a discharging port 313$A_R$ of one discharging path 302$A_R$ is communicated with the other collecting port (not shown) of the cut staple receiving portion 6A.

The discharging path 302A has a configuration in which the discharging path 302A, the discharging path 302$A_L$ and the discharging path 302$A_R$ are inclined such that the discharging ports 313$A_L$, 313$A_R$ are lower than the cutting portion 30A. Therefore, the cut staples 13A are collected from the temporary receiving portion 309A to the cut staple receiving portion 6A by their own weight.

<Exemplary Configuration of Image Formation System and Post-Processing Device>

Figure 6:
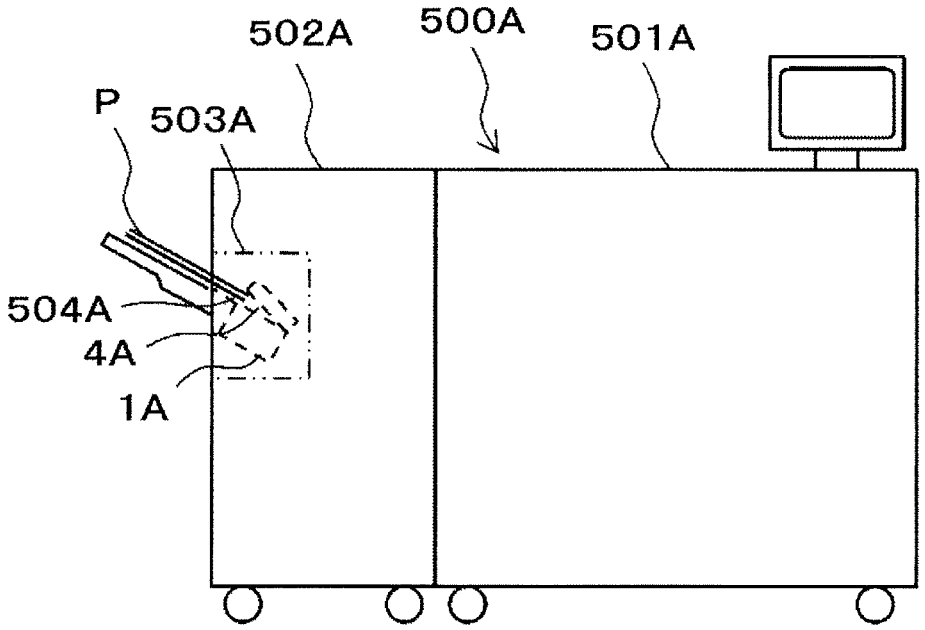
FIG. 6 is a configuration view showing an outline of an image formation system of the present embodiment.
Figure 7:
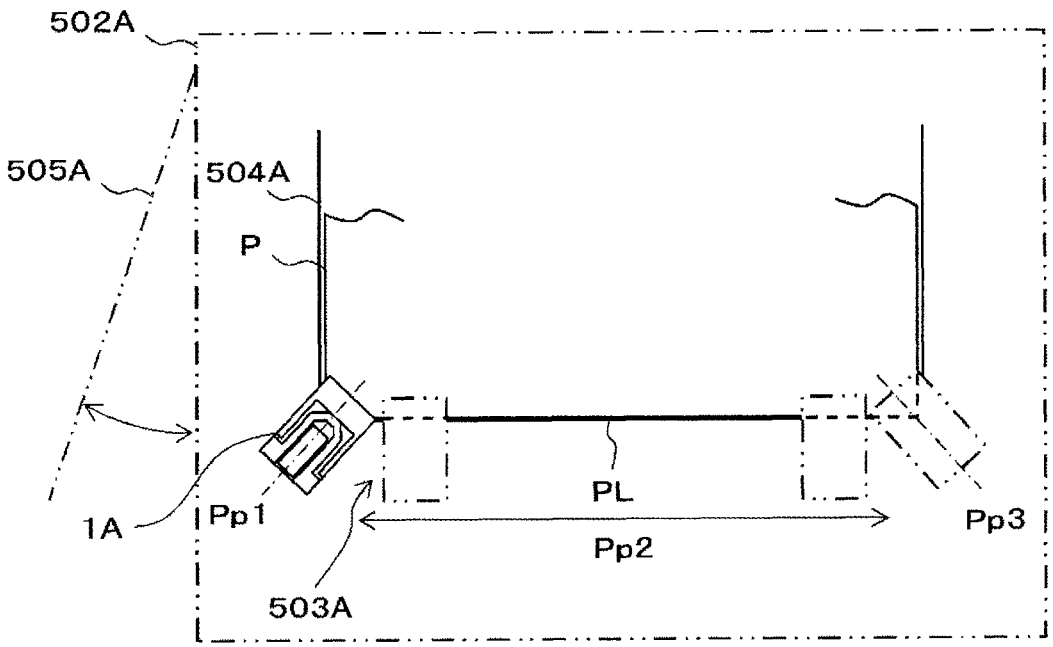
FIG. 7 is a configuration view showing one example of a post-processing device of the present embodiment.

FIG. 6 is a configuration view showing an outline of an image formation system of the present embodiment, and FIG. 7 is a configuration view showing one example of a post-processing device of the present embodiment.

The image formation system 500A of the present embodiment has an image formation device 501A and a post-processing device 502A capable of performing at least one kind of processing. The image formation device 501A is configured to form an image on a sheet of paper P fed from a paper feeding portion (not shown), which is provided inside or outside the device, and then to output the sheet of paper P. In the present example, the image formation device 501A is configured to form an image on the sheet of paper P by forming an electrostatic latent image by scanning exposure, developing the electrostatic latent image by a toner, and then transferring and fixing the toner onto the sheet of paper.

The post-processing device 502A of the present embodiment has the stapler 1A on a binding portion 503A thereof. The binding portion 503A has a stacking portion 504A in which sheets of paper P outputted from the image formation device 501A are stacked.

FIG. 7 is a view of the binding portion 503A of the post-processing device 502A as viewed from above. As shown in FIG. 7, the stapler 1A is configured to be moved to a first position Pp1 where the sheets of paper P stacked in the stacking portion 504A are bound at one corner, a second position Pp2 where the sheets of paper P are bound at any location along a side PL thereof, and a third position Pp3 where the sheets of paper P are bound at another corner, by a moving unit (not shown). In the present example, the first position Pp1 also serves as a reference position, which is a home position (HP). In the present example, attaching and detaching of the cut staple receiving portion 6A is performed by moving the stapler 1A to the first position Pp1 and then opening a door 505A.

Exemplary Operation and Effects of Stapler of the Present Embodiment

Figure 8:
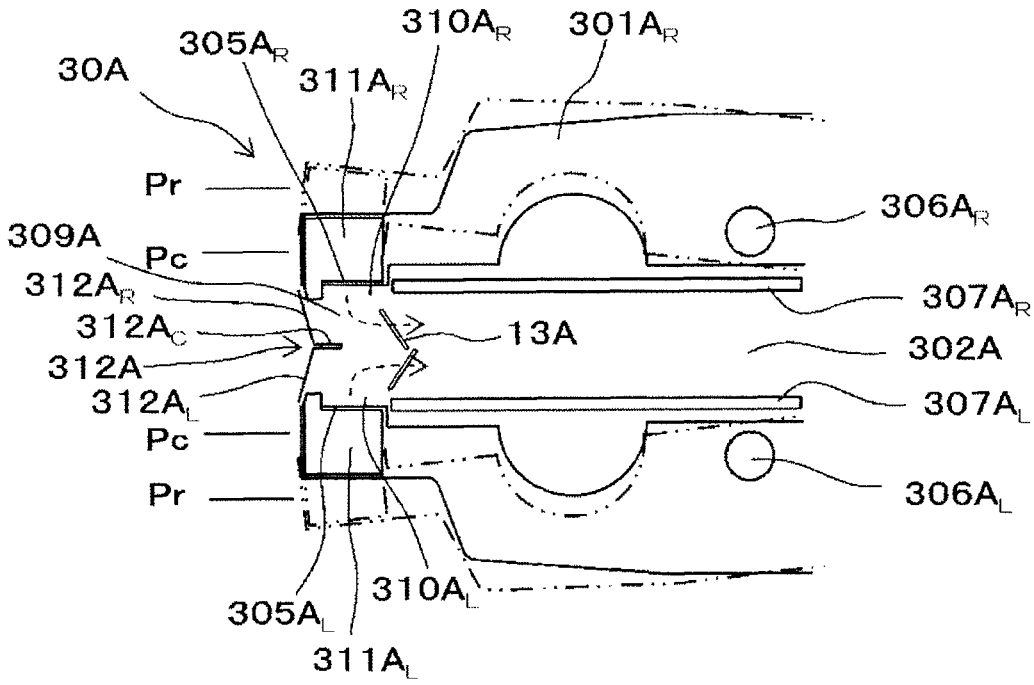
FIG. 8 is an explanatory view showing one example of operation of the cutting portion of the present embodiment.

FIG. 8 is an explanatory view showing one example of an operation of the cutting portion of the present embodiment, and hereinafter, the operation of the stapler of the present embodiment will be described with reference to each of the figures.

During an operation of binding sheets of paper P with the stapler 1A, as shown in FIG. 2, sheets of paper P is clamped between the first clamping portion 40A of the staple striking portion 2A and the second clamping portion 41A of the binding unit 3A. Also, in the staple striking portion 22A shown in FIG. 1, one staple 10A shaped in a generally U-shape as shown in FIG. 3A and the like are separated and struck out from a staple sheet (not shown). Therefore, the staple legs 12A of the staple 10A before being cut penetrate the sheets of paper P.

A surplus part of one staple leg 12A which have penetrated the sheets of paper P is introduced into the introduction portion 300$A_L$ of the cutting portion 30A and a surplus part of the other staple leg 12A is introduced into the introduction portion 300$A_R$. When an operation of striking the staple 10A to penetrate the sheets of paper P is ended, the pair of cutting member 301$A_L$, 301$A_R$ are moved from the waiting positions Pr, which are shown by a two-dotted chain line, to the cutting ending positions Pc, which are shown by a solid line.

When the cutting member 301$A_L$ is moved from the waiting position Pr to the cutting ending position Pc, one staple leg 12A which is positioned in the introduction portion 300$A_L$ is clamped between the blade portion 305$A_L$ of the cutting portion 301$A_L$ and the support portion 304$A_L$. Therefore, the staple leg 12A is cut by a shear force exerted thereon.

The cut staple 13A, which is the staple leg cut by the cutting member 301$A_L$, enters the temporary receiving portion 309A through the inlet portion 310$A_L$. The cut staple 13A cut by the cutting member 301$A_L$ is directed toward the inlet portion 310$A_R$ by a force exerted from the cutting member 301$A_L$.

The cut staple 13A, which enters the temporary receiving portion 309A through one inlet portion 310$A_L$ and then is directed toward the other inlet portion 310$A_R$, collides against the partition plate 312A and then is directed rearward by moving along the direction regulation portion 312$A_L$ and the shield portion 312$A_C$ as shown by a broken line. Therefore, the cut staple 13A, which has entered the temporary receiving portion 309A through the inlet portion 310$A_L$, is inhibited from being directed toward the inlet portion 310$A_R$ and thus is directed toward the discharging path 302A.

When the cutting member 301$A_R$ is moved from the waiting position Pr to the cutting ending position Pc, the other staple leg 12A which is positioned in the introduction portion 300$A_R$ is clamped between the blade portion 305$A_R$ of the cutting portion 301$A_R$ and the support portion 304$A_R$. Therefore, the staple leg 12A is cut by a shear force exerted thereon.

The cut staple 13A, which is the staple leg cut by the cutting member 301$A_R$, enters the temporary receiving portion 309A through the inlet portion 310$A_R$. The cut staple 13A cut by the cutting member 301$A_R$ is directed toward the inlet portion 310$A_R$ by a force exerted from the cutting member 301$A_R$.

The cut staple 13A, which enters the temporary receiving portion 309A through the other inlet portion 310$A_R$ and then is directed toward the other inlet portion 310$A_L$, collides against the partition plate 312A and then is directed rearward by moving along the direction regulation portion 312$A_R$ and the shield portion 312$A_C$ as shown by a broken line. Therefore, the cut staple 13A, which has entered the temporary receiving portion 309A through the inlet portion 310$A_R$, is inhibited from being directed toward the inlet portion 310$A_L$ and thus is directed toward the discharging path 302A.

Then, the cut staples 13A directed toward the discharging path 302A enter the discharging path 302$A_L$ or the discharging path 302$A_R$ from the discharging path 302A by their own weight and then are collected in the cut staple receiving portion 6A.

According to the stapler 1A of the present embodiment, the cut staples 13A cut by the cutting member 301$A_L$, 301$A_R$ enter the temporary receiving portion 309A through the inlet portion 310$A_L$ and the inlet portion 310$A_R$ provided on side surfaces thereof. However, the temporary receiving portion 309A does not have any opening provided on a lower surface thereof to allow the staple legs 12A to be introduced therein. Therefore, the cut staples 13A which have entered the temporary receiving portion 6A are inhibited from being dropped to the outside.

Also, when the cutting members 301$A_L$, 301$A_R$ move to the cutting end positions Pc, the inlet portion 310$A_L$, 310$A_R$ are respectively closed with the lid portions 311$A_L$, 311$A_R$. Therefore, the cut staples 13A are inhibited from being dropped to the outside through the inlet portions 310$A_L$, 310$A_R$.

Further, a moving direction of the cut staples 13A which enter the temporary receiving portion 309A is guided toward the discharging path 302A by the partition plate 312A and the direction regulation portions 312$A_L$, 312$A_R$. Also, the discharging path 302 extends from the temporary receiving portion 309A in a linear shape. Therefore, the cut staples 13A which have entered the temporary receiving portion 309A are inhibited from staying in the temporary receiving portion 309A. As a result, it is inhibited that, after an operation of binding the sheets of paper P is ended, the cut staples 13A staying the receiving portion 309A are dropped to the outside when the cutting members 301$A_L$, 301$A_R$ are moved to the waiting positions Pr and thus the inlet portions 310$A_L$, 310$A_R$ are opened.

| | |
|---|---|
| 1A | Stapler |
| 10A | Staple |
| 12A | Staple leg |
| 2A | Staple striking unit |
| 21A | Feeding portion |
| 22A | Striking portion |
| 3A | Binding unit |
| 30A | Cutting portion |
| 31A | Clincher portion |
| 32A | Shaft |
| 4A | Paper clamping portion |
| 40A | First clamping portion |
| 41A | Second clamping portion |
| 42A | Paper position restriction portion |
| 5A | Drive unit |
| 6A | Cut staple receiving portion |
| 100A | Staple cartridge |
| 300$A_L$, 300$A_R$ | Introduction portion |
| 301$A_L$, 301$A_R$ | Cutting member |
| 302A | Discharging path |
| 303A | Support plate |
| 304A | Protrusion |
| 304$A_L$, 304$A_R$ | Support portion |
| 305$A_L$, 305$A_R$ | Blade portion |
| 306$A_L$, 306$A_R$ | Shaft |
| 307$A_L$, 307$A_R$ | Wall portion |
| 308A | Top plate |
| 309A | Temporary receiving portion |
| 310$A_L$, 310$A_R$ | Inlet portion |
| 311$A_{L,\ 311AR}$ | Lid portion |
| 312A | Partition plate |
| 313$A_L$, 313$A_R$ | Discharging port |

The invention claimed is:

1. A stapler comprising:

a staple striking portion configured to strike a staple to penetrate sheets of paper;

a cutting portion configured to cut staple legs of the staple penetrating the sheets of paper; and a binding portion configured to bind the sheets of paper by bending the staple legs of the staple penetrating the sheets of paper, wherein the cutting portion comprises:

a support plate which includes a flat upper surface, the support plate further including a protrusion in a central region thereof;

the protrusion protruding from the support plate in a first direction and having a width narrower than a width of a staple crown of the staple;

a first support portion on a first side surface of the protrusion;

a second support portion on a second side surface of the protrusion;

wherein the width of the protrusion extends between the first and second support portions, and the flat upper surface of the support plate includes a flat upper portion of the protrusion between the first and second support portions;

a first blade portion which is disposed outside the first support portion and opposing the first support portion, and which is movable in a direction approaching the first support portion;

a second blade portion which is disposed outside the second support portion and opposing the second support portion, and which is movable in a direction approaching the second support portion;

a first introduction portion which is formed by a groove between the first support portion and the first blade portion, and into which one of the staple legs penetrating the sheets of paper is introduced;

a second introduction portion which is formed by a groove between the second support portion and the second blade portion, and into which the other of the staple legs penetrating the sheets of paper is introduced; and a discharging path extending rearward from between the first introduction portion and the second introduction portion, the discharging path extending in a second direction opposite to the first direction in which the protrusion extends;

wherein the first blade portion is configured to cut the staple leg introduced into the first introduction portion by approaching the first support portion;

wherein the second blade portion is configured to cut the staple leg introduced into the second introduction portion by approaching the second support portion;

wherein the discharging path is disposed between the first introduction portion and the second introduction portion, and comprising:

a temporary receiving portion which is configured to receive cut staple legs temporarily;

a first inlet portion connecting the first introduction portion and the temporary receiving portion, and into which one of the cut staple legs is inserted; and a second inlet portion connecting the second introduction portion and the temporary receiving portion, and into which the other of the cut staple legs is inserted, wherein the first and second blade portions, the first and second introduction portions, the first and second inlet portions, and the temporary receiving portion are each located on or proximate to the protrusion in the central region of the support plate and on or proximate to the flat upper surface of the support plate, wherein the cut staple legs which are inserted from the first inlet portion and the second inlet portion are discharged in the second direction and to the rear of the discharging path through the temporary receiving portion, and wherein the temporary receiving portion comprises a partition member configured to block between the first and second inlet portions.

2. The stapler according to claim 1, wherein the partition member comprises a direction regulation portion configured to guide the cut staples, which enter the temporary receiving portion through the first inlet portion and the second inlet portion, toward the discharging path and in the second direction.

3. The stapler according to claim 1 further comprising a cut staple receiving portion configured to receive the cut staples cut by the cutting portion, wherein the discharging path is configured to discharge the cut staples to the cut staple receiving portion.

4. The stapler according to claim 1, wherein the discharging path extends downwardly.

5. The stapler of claim 1, wherein the first blade portion is rotated about a first shaft, and the second blade portion is rotated about a second shaft, the first and second shafts each having an axis extending orthogonal to the support plate.

6. The stapler according to claim 5, wherein the first and second shafts are connected to and extend through the support plate.

7. The stapler according to claim 1, wherein the protrusion and the first and second blade portions are positioned to cut the staple legs against the first and second support portions on the first and second side surfaces of the protrusion and so that the cut staple legs fall on the flat upper portion of the protrusion after cutting.

* * * * *